US007716946B2

(12) United States Patent
Fralick et al.

(10) Patent No.: US 7,716,946 B2
(45) Date of Patent: May 18, 2010

(54) ACCUMULATOR WITH DEFLECTOR

(75) Inventors: Lisa Marie Fralick, Foxboro (CA); Jennifer Lynn Dexter, Belleville (CA); Daniel Leonard Corrigan, Belleville (CA); Ian A. N. McGregor, Belleville (CA); Nicholas McDonagh Cristello, Kingston (CA); Timothy Russell Dickson, Kingston (CA)

(73) Assignee: Halla Climate Control Canada Inc. (CA)

( * ) Notice: Subject to any disclaimer, the term of this patent is extended or adjusted under 35 U.S.C. 154(b) by 172 days.

(21) Appl. No.: 12/131,535

(22) Filed: Jun. 2, 2008

(65) Prior Publication Data

US 2008/0223073 A1 Sep. 18, 2008

Related U.S. Application Data

(62) Division of application No. 10/906,119, filed on Feb. 3, 2005, now Pat. No. 7,461,519.

(51) Int. Cl.
*F25B 43/00* (2006.01)
*F25B 43/02* (2006.01)

(52) U.S. Cl. ..... 62/503; 62/471; 62/512

(58) Field of Classification Search ..... 62/503, 62/512, 470, 471, 474, 475; 29/902, 903
See application file for complete search history.

(56) References Cited

U.S. PATENT DOCUMENTS

| | | | |
|---|---|---|---|
| 4,111,005 | A | 9/1978 | Livesay |
| 4,199,960 | A | 4/1980 | Adams et al. |
| 4,229,949 | A | 10/1980 | Brandin |
| 4,270,934 | A | 6/1981 | Widdowson et al. |
| 4,331,001 | A | 5/1982 | Jones |
| 4,354,362 | A | 10/1982 | Schumacher et al. |
| 4,458,505 | A | 7/1984 | Griffin |
| 4,474,035 | A | 10/1984 | Amin et al. |
| 4,509,340 | A | 4/1985 | Mullally |
| 4,627,247 | A | 12/1986 | Morse |
| 4,633,679 | A | 1/1987 | Wintersteen |
| 4,651,540 | A | 3/1987 | Morse |
| 4,768,355 | A | 9/1988 | Breuhan et al. |
| 4,994,185 | A | 2/1991 | Cullen et al. |
| 5,052,193 | A | 10/1991 | Pettitt et al. |

(Continued)

FOREIGN PATENT DOCUMENTS

| | | |
|---|---|---|
| CA | 1272384 | 8/1990 |

(Continued)

*Primary Examiner*—Chen-Wen Jiang
(74) *Attorney, Agent, or Firm*—Husch Blackwell Sanders LLP

(57) ABSTRACT

A deflector for an accumulator for an air conditioning system acts as a barrier to substantially prevent incoming liquid from entering a conduit which is primarily for gas. Fluid entering the accumulator comprises gas and liquid. The deflector also assists with the separation of gas from liquid, with reduced turbulence, to decrease the likelihood of liquid becoming re-entrained within the gas. An initial contact surface of the deflector receives the incoming fluid. The initial contact surface is substantially convex, so that liquid reflecting off the surface will be travel in a direction away (or different) from the flow of incoming fluid. The initial contact surface is also angled to direct liquid reflecting off it (or flowing down it) downward and outward.

13 Claims, 13 Drawing Sheets

U.S. PATENT DOCUMENTS

| | | | |
|---|---|---|---|
| 5,177,982 | A | 1/1993 | Plemens |
| 5,179,844 | A | 1/1993 | Lyman et al. |
| 5,184,479 | A | 2/1993 | Koberstein et al. |
| 5,201,792 | A | 4/1993 | Study |
| 5,347,829 | A | 9/1994 | Newman |
| 5,471,854 | A | 12/1995 | DeNolf |
| 5,570,589 | A | 11/1996 | Petty |
| 5,660,058 | A | 8/1997 | Harris et al. |
| 5,701,758 | A | 12/1997 | Haramoto et al. |
| 5,729,998 | A | 3/1998 | Grohs et al. |
| 5,746,065 | A | 5/1998 | Patel et al. |
| 5,778,697 | A | 7/1998 | Wantuck |
| 5,787,573 | A | 8/1998 | Pytel et al. |
| 5,787,729 | A | 8/1998 | Wijaya |
| 5,904,055 | A | 5/1999 | Slais |
| 6,167,720 | B1 | 1/2001 | Chisnell |
| 6,196,019 | B1 | 3/2001 | Higo et al. |
| 6,430,958 | B1 | 8/2002 | Corrigan et al. |
| 6,463,757 | B1 | 10/2002 | Dickson et al. |
| 6,612,128 | B2 | 9/2003 | Dickson et al. |

FOREIGN PATENT DOCUMENTS

| | | |
|---|---|---|
| CA | 1280615 | 2/1991 |
| CA | 2204694 | 8/2000 |

ACCUMULATOR WITH DEFLECTOR

CROSS REFERENCE TO RELATED APPLICATION

This Application is a Divisional Application of application Ser. No. 10/906,119 filed Feb. 3, 2005, now published, of the same title, the disclosure of which is incorporated herein by reference.

FIELD OF THE INVENTION

The invention relates to suction accumulators for refrigeration or air/conditioning system use and is particularly concerned with deflectors used with accumulators.

BACKGROUND OF THE INVENTION

Closed-loop refrigeration systems conventionally employ a compressor that is meant to draw in gaseous refrigerant at relatively low pressure and discharge hot refrigerant at relatively high pressure. The hot refrigerant condenses into liquid as it is cooled in a condenser. A small orifice or valve divides the system into high and low-pressure sides. The liquid on the high-pressure side passes through the orifice or valve and turns into a gas in the evaporator as it picks up heat. (Some systems operate in "transcritical" mode, in that the hot refrigerant is merely cooled in a high side heat exchanger, now termed a "gas cooler", and turns to gas plus liquid as it passes through the expansion device.) At low heat loads, it is not desirable or possible to evaporate all the liquid in the evaporator. However, excess liquid refrigerant entering the compressor (known as "slugging") causes system efficiency loss and can cause damage to the compressor. Hence it is standard practice to include a reservoir between the evaporator and the compressor to separate and store the excess liquid. It is also a reservoir for excess refrigerant, which is typically added to the system during manufacture to compensate for unavoidable leakage during the working life of the system. This reservoir is called a suction line accumulator, or simply an accumulator.

An accumulator is typically a metal can, welded together, and often has fittings attached for a switch, transducer and/or charge port. One or more inlet tubes and an outlet tube pierce the top, sides, or occasionally the bottom, or attach to fittings provided for that purpose. The refrigerant flowing into a typical accumulator will impinge upon a deflector or baffle intended to reduce the likelihood of liquid flowing out the exit, generally by removing kinetic energy from the liquid so it settles quietly into the reservoir area without churning or splashing. Some patents describe accumulators without deflectors (such as U.S. Pat. Nos. 5,179,844 and 5,471,854). However, the lack of a deflector reduces effective reservoir volume and reduces efficiency by allowing churning and splashing that returns unnecessary liquid to the compressor—that is, by allowing liquid carryover. Moreover, even when deflectors have been used in the past, the deflectors have contributed to turbulence, when the incoming fluid rebounds off the deflectors.

A consequence of using a suction line accumulator is that compressor oil can become trapped within it. Compressor oil is circulated with the refrigerant in most systems in current usage. Even if a separator is used, a small amount of oil escapes into the system. This oil will find its way into the accumulator, and while liquid refrigerant may be expected to evaporate and return to circulation as needed, the oil does not evaporate. Some means must be provided to return this oil to circulation. A known practice is to use a J-shaped outlet tube to carry the exiting gaseous refrigerant from the top of the accumulator down to the bottom and then back up to the outlet from the accumulator. A carefully sized orifice at the bottom of this "J-tube" (sometimes also referred to as a "U-tube") entrains the oil from the bottom of the liquid area into the stream of exiting gas. A recent development in accumulator design is to incorporate a plastic liner in the accumulator to assist with the oil pick up function (as shown in U.S. Pat. Nos. 6,612,128 and 6,463,757).

While previous deflector and accumulator designs have considered configurations to help prevent liquid refrigerant from exiting the accumulator, the previous designs do not appear to have addressed deflector design to improve the separation of liquid from vapour (while maintaining little liquid carryover).

Deflectors within accumulators have typically been designed to act only as shields to protect an outlet tube (or a J-tube or a gas flow tube (all of which may be referred to as a conduit primarily for gas)) from stray liquid refrigerant. It would be desirable to have a deflector that improves the separation of liquid and gas, while also protecting the outlet (or gas flow tube) from liquid refrigerant.

SUMMARY OF THE INVENTION

Computational Fluid Dynamics (CFD) calculations were used to study the path of fluid entering an accumulator and its reaction with the deflector surfaces in greater detail than previously. This allowed for a more in-depth study of the critical features of the deflector surfaces, and led to embodiments of the present invention incorporating novel deflector designs with improved configuration of deflector surfaces to disperse a greater amount of kinetic energy, thereby yielding improved gas/liquid separation.

The geometry of an initial contact surface of a deflector according to one embodiment of the present invention provides for inbound refrigerant and oil to be separated into its liquid and gas components with minimal or less interaction with the initial contact surface. The liquid and gas are allowed only minimal interaction upon contact with the deflector to avoid or reduce the likelihood of liquid re-entrainment.

In an accumulator without a liner, the liquid refrigerant and oil are then directed towards or near an inner surface of the accumulator, where gravity pulls the liquid down.

In one type of liner-style accumulator, the liquid refrigerant is then directed to interior walls of a liner while the gas flows toward a gas flow conduit. The oil and liquid refrigerant flow downward due to gravity, along an inside surface of the liner, to the bottom of the liner, while the gaseous refrigerant migrates toward an inlet of the gas flow conduit. The gas flow conduit is designed to direct the gas downward, underneath the liner. As gas flows under the liner, oil is entrained within the gas flow, through an oil bleed orifice located at or near a zenith in the liner.

In accordance with another aspect of the present invention, a deflector is provided for an accumulator where deflector surfaces disperse a greater amount of kinetic energy (than previous designs), thereby yielding improved gas/liquid separation.

Embodiments of the accumulators and related designs described herein could be used in air conditioning systems within vehicles. Embodiments of the accumulators and related designs described herein could also be used in stationary air conditioning and/or refrigeration systems (commercial and industrial).

According to a further aspect, the invention provides an accumulator for an air conditioning system, the accumulator comprising an outer body, a liner inside and spaced from the outer body, a conduit primarily for gas, and a deflector comprising a generally cylindrical circumference with an inner surface, wherein the inner surface of the circumference of the deflector is adjacent an inside surface of the liner and the deflector further comprising a separation/protection means to separate liquid from gas, wherein a portion of the separation/protection means comprises a barrier to substantially prevent liquid from entering the conduit and a portion of the separation/protection means comprises an initial contact surface for directing fluid away from a flow of incoming fluid, wherein the initial contact surface is substantially convex across the initial contact surface and the initial contact surface, as seen from an upper edge to a lower edge thereof, is angled away from the flow of incoming fluid.

According to a further aspect, the invention provides an accumulator for an air conditioning system, the accumulator comprising an inlet to supply incoming fluid, the inlet being located on a side of the accumulator, the accumulator further comprising a deflector and a conduit primarily for gas, the deflector comprising a separation/protection means to separate liquid from gas, wherein the separation/protection means comprises a barrier to substantially prevent liquid from entering the conduit and the separation/protection means comprises an initial contact surface for directing fluid down and away from a flow of incoming fluid, wherein the initial contact surface is substantially convex across the initial contact surface and the initial contact surface, as seen from an upper edge to a lower edge thereof, is angled away from the flow of incoming fluid.

According to yet another aspect, the invention provides an accumulator for an air conditioning system, the accumulator comprising: a deflector, a conduit primarily for gas, an outer body, an inlet to supply incoming fluid, the inlet being located within a top of the outer body to direct incoming fluid downward, and a separation/protection means to separate liquid from gas, the separation/protection means comprises a barrier to substantially prevent liquid from entering the conduit and a portion of the separation/protection means comprises an initial contact surface for directing fluid down and away from a flow of incoming fluid, wherein the initial contact surface is located generally opposite the inlet and the initial contact surface is substantially convex across the initial contact surface and slopes downward and outward to direct fluid in a direction away from an entrance of the conduit, and the initial contact surface as seen from an upper edge to a lower edge thereof, is angled away from the flow of incoming fluid, and the barrier of the separation/protection means comprises a wall extending across the deflector, with the inlet being located on one side of the barrier and an opening of the conduit being located on the other side of the barrier.

Different embodiments of the present invention may provide some of the following features and advantages: an accumulator having a deflector where the deflector not only helps prevent liquid from flowing directly into a conduit for gas, but also helps separation of liquid from gas; a deflector for an accumulator, where the configuration of the deflector disperses kinetic energy to provide improved liquid/gas separation; a deflector for an accumulator designed to separate liquid from gas with less interaction between the liquid and gas or with less turbulence to avoid or reduce the likelihood of liquid re-entrainment with the gas; an accumulator having a gas flow tube inside the accumulator where an entrance to the gas flow tube is located near a top of the accumulator, thereby increasing the effective accumulator volume (because a greater volume of liquid can be stored in the accumulator without the liquid flowing into the gas flow tube); an accumulator providing improved performance; an accumulator which is relatively easy to manufacture and fits multiple installation configurations; an accumulator which is more cost-effective and more flexible.

BRIEF DESCRIPTION OF THE DRAWINGS

Preferred embodiments of the invention will now be described with reference to the attached drawings in which:

FIGS. 2*a*-2*f* are different views of the SISO deflector of FIG. 1*a* in which:

FIG. 2*a* is a perspective view looking down;

FIG. 2*b* is a perspective view looking up;

FIG. 2*c* is a top view;

FIG. 2*d* is a perspective sectional view;

FIG. 2*e* is a bottom view looking up; and

FIG. 2*f* is a side view of the initial contact surface;

FIGS. 4*a*-4*d* are different views of a TISO deflector for the accumulator of FIG. 3 in which:

FIG. 4*a* is a perspective view;

FIG. 4*b* is a perspective sectional view;

FIG. 4*c* is a top view; and

FIG. 4*d* is a bottom view;

DETAILED DESCRIPTION

Figure 1A:
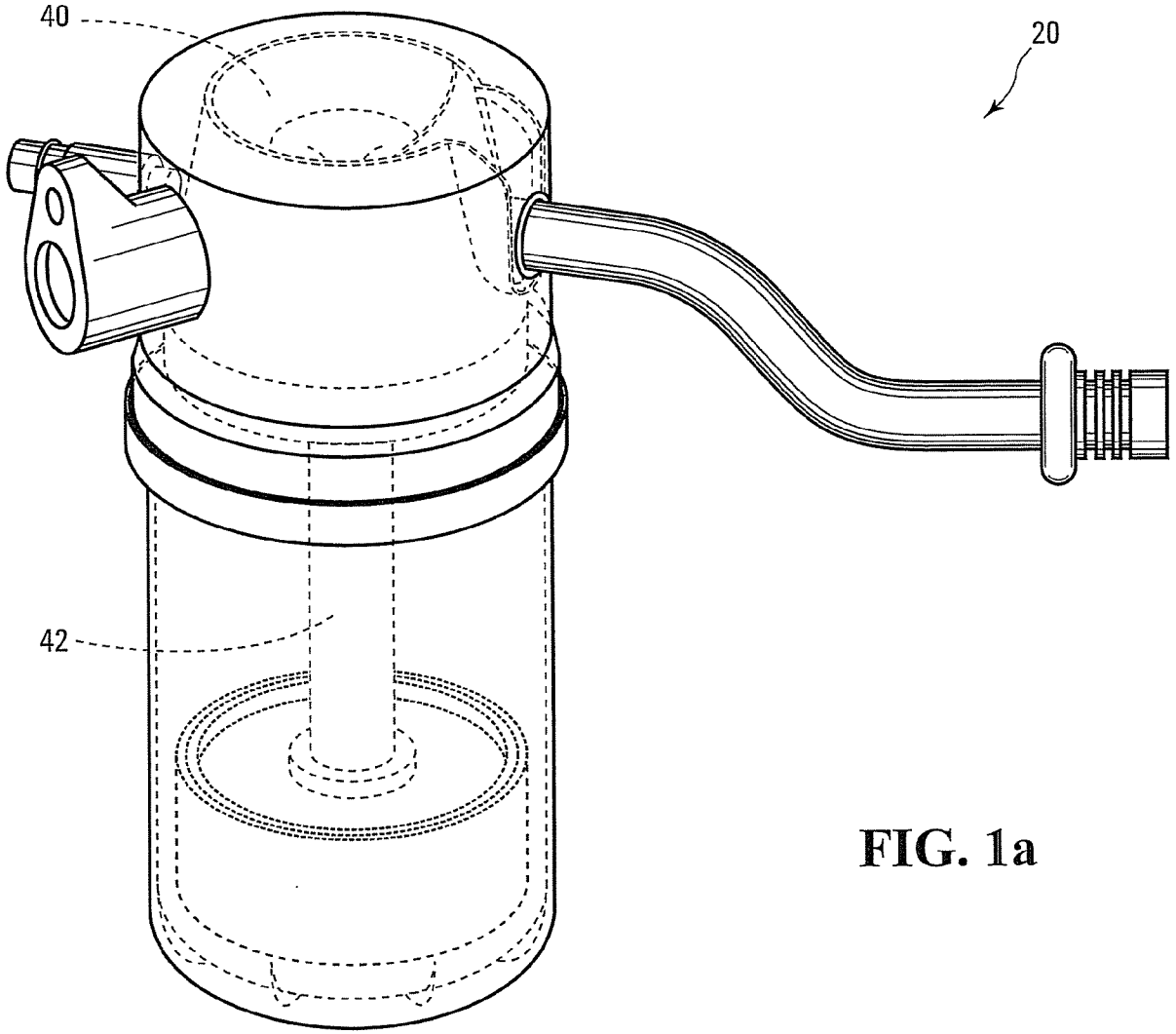
FIG. 1*a* is a perspective view of a side-in-side-out (SISO) accumulator (with some of the internal components shown in dotted outline) in accordance with an embodiment of the present invention.
Figure 1B:
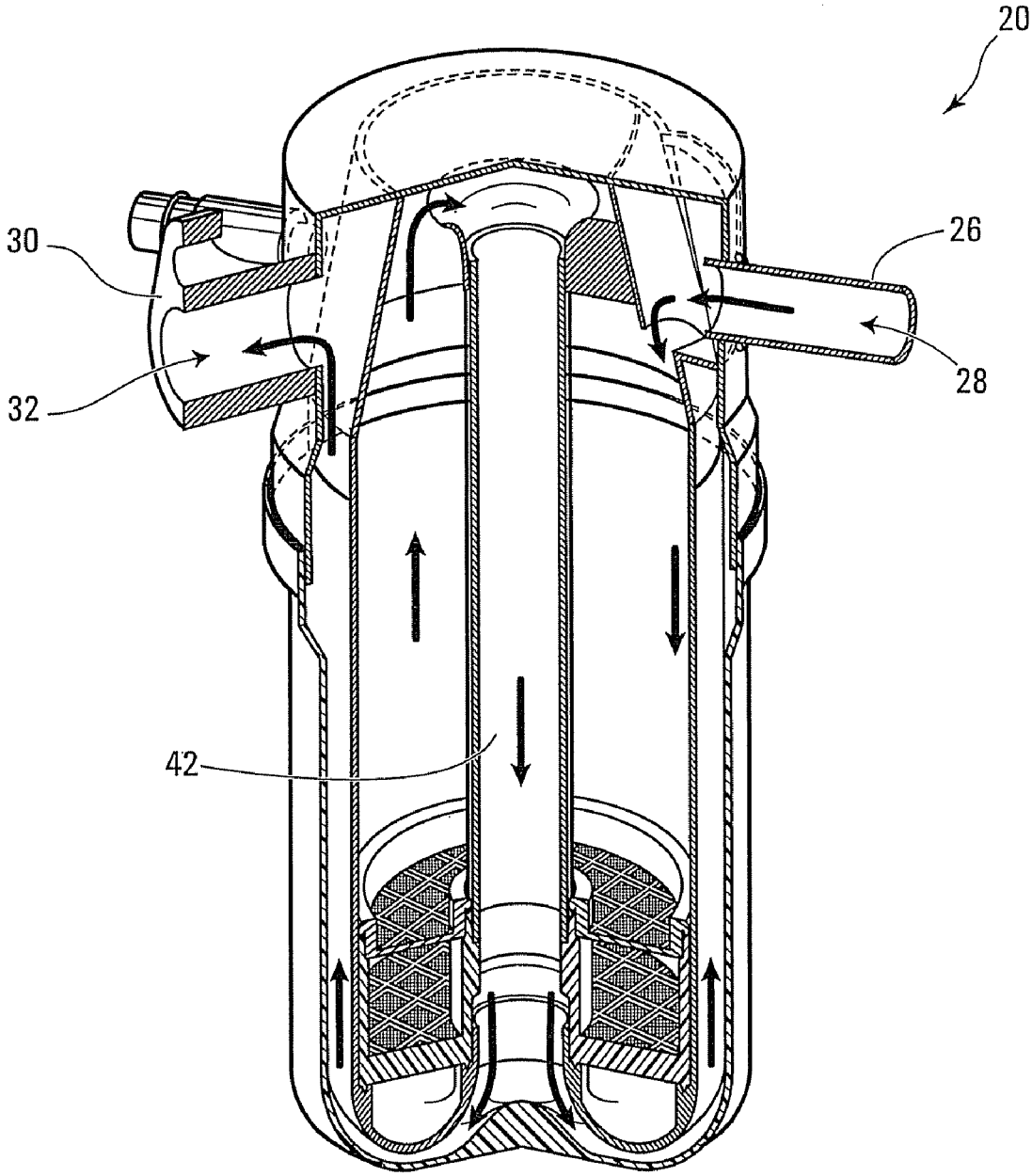
FIG. 1*b* is a vertical sectional view of the accumulator of FIG. 1*a*, with arrows showing the direction of flow within the accumulator.
Figure 1C:
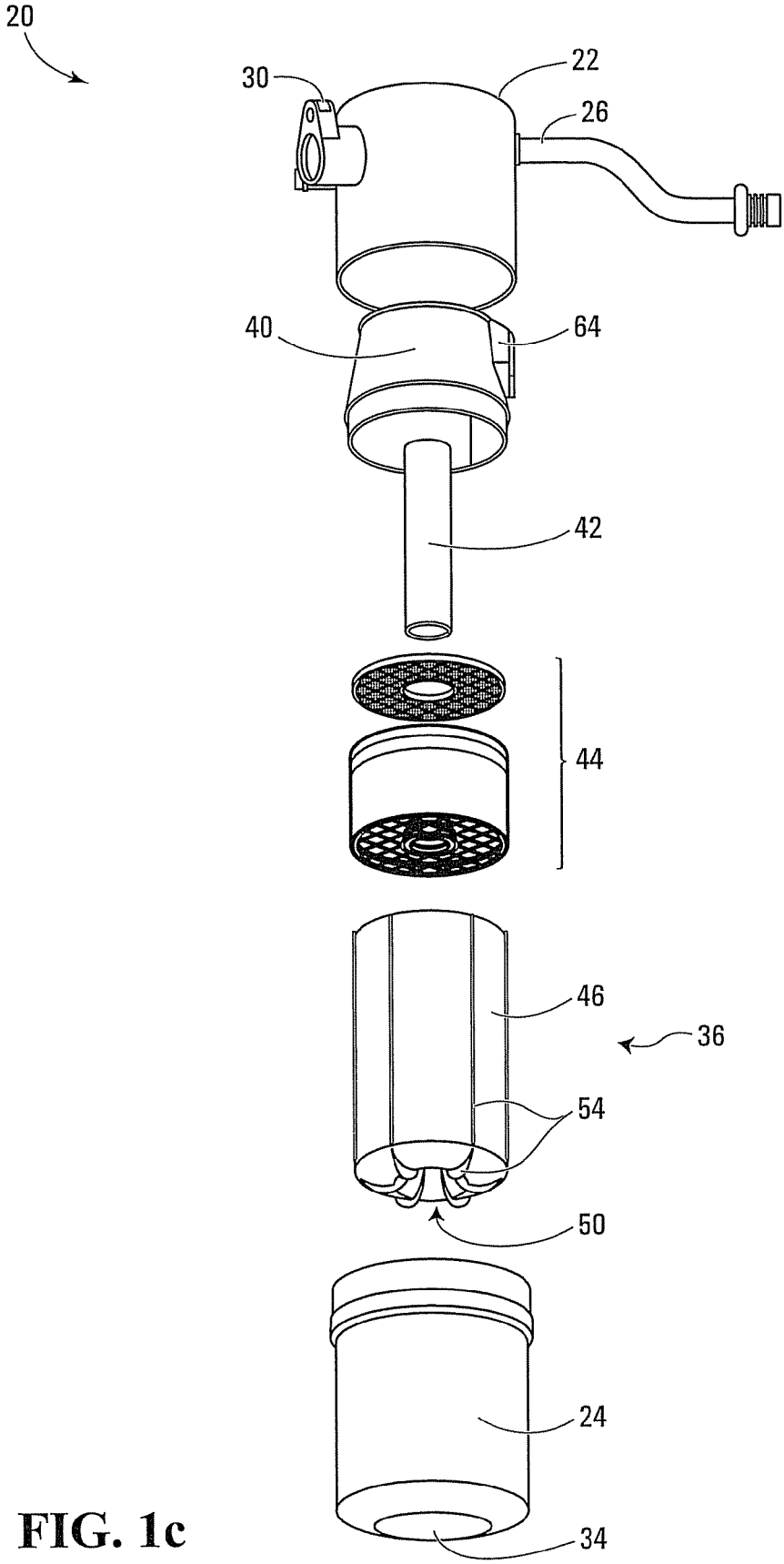
FIG. 1*c* is an exploded view of the accumulator of FIG. 1*a;*

As shown in FIGS. 1*a*-1*c*, an accumulator 20 has an outer body or housing formed by a top canister 22 and a bottom canister 24. The top canister 22 fits securely and sealingly with the bottom canister 24. The combination, in this embodiment, of the top canister 22 and the bottom canister 24 may be referred to as an outer body. The top canister 22 comprises and inlet fitting 26 and an outlet fitting 30. In this embodiment, both the inlet fitting 26 and the outlet fitting 30 extend from or are formed in the side(s) or surface of the top canister 22. The inlet fitting 26 is adapted to accommodate an inlet tube 28. The outlet fitting 30 is adapted to accommodate an outlet conduit (not shown). The bottom canister 24 is generally cylindrical, with a closed bottom or floor 34 and an open top.

Within the accumulator 20 are (among other possible features): a liner 36, which is secured within the bottom canister 24 of the accumulator 20; a deflector 40, which is secured near a top portion of the accumulator 20; and a gas flow tube or conduit 42, which extends within the accumulator 20, partway along the height of the accumulator 20. The accumulator may also incorporate a desiccant container 44.

As shown in FIG. 1*c*, the liner 36 is generally cylindrical (which could also be considered to include a truncated cone shape, or an octagonal shape, or an oval shape or even a rectangular shape, for example), having an outer surface 46, with a diameter slightly less than that of the bottom canister 24. The top of the liner 36 is open. From the top of the liner 36, the outer surface 46 of the liner 36 extends downward. Near a bottom portion of the liner 36, the outer surface 46 extends inwardly to a nadir. From or near the nadir, the outer surface 46 extends inwardly and upwardly, to form a generally circular liner outlet or opening 50. Formed within the liner 36, advantageously at or near the nadir of the liner 36, is an oil bleed orifice 52 (not shown). Extending along, and spaced evenly around the outer surface 46 of the liner 36, are liner ribs 54.

As suggested in FIGS. 1*a*-1*c*, the deflector 40 is secured within the accumulator 20. The defector 40 is shown in different views in FIGS. 2*a*-2*f*. The deflector 40 has an outer wall (or circumference) 60, having a generally truncated, conical shape, in this embodiment. The outer wall 60 could be considered generally cylindrical which could also describe many variations, including octagonal, oval, or rectangular shapes, for example. The deflector 40 has a lower portion 61, which is indented by a step 62. The outer wall 60 has an inner surface 63.

The deflector 40 in this embodiment has an inlet entrance 64, being generally u-shaped and projecting out from the outer wall 60. The inlet entrance 64 could assume other shapes, provided that fluid entering the accumulator 20 is directed into the deflector 40.

Two vertical deflector ribs 66 are shown extending outward from the outer wall 60. The vertical deflector ribs 66 are adapted to ensure that the deflector 40 fits securely within the top canister 22. Other or additional means could also be used to secure the deflector 40 within the top canister 22.

An initial contact surface 70 (which may also be referred to as a separation/protection means) extends across a portion of the deflector 40, from one portion of the inner surface 63 of the outer wall 60 to another portion of the inner surface 63. The initial contact surface 70, in this embodiment, is generally centered (in the left-right orientation, as seen in FIG. 2*c*, for example) with respect to the inlet entrance 64. A top (or upper) edge 73 of the initial contact surface 70 is approximately flush or even with a top edge of the deflector 40. A lower edge 72 of the initial contact surface 70 creates a generally inverted U-shape. Although not shown, the lower edge 72 may have a beaded rim (or may be somewhat bulbous) to help liquid adhere to the edge 72. The beaded rim helps to ensure that any liquid that adheres to the edge 72 is held on the rim and is directed towards the inner surface 63 and is not carried with the flowing gas. The lower edge 72 of the initial contact surface 70 may extend down at least as far, and, advantageously further, than a lower edge of the inlet entrance 64 of the deflector 40. In a top view (looking down), the initial contact surface 70 has a slight arc, as shown, for example, in FIG. 2*c*. In other words, from the perspective of incoming fluid, the initial contact surface 40 is convex (in the direction across the initial contact surface 40). As well, from a top edge 73 to the lower edge 72 of the initial contact surface 70, the initial contact surface 70 is angled inward. In other words, the initial contact surface 70, as seen from the upper edge 73 to the lower edge 72, is angled away from the flow of incoming fluid.

A gas flow tube socket 74 is supported within the deflector 40. In this embodiment, the gas flow tube socket 74 is part of deflector 40, although it need not be. The gas flow tube socket 74 has an opening 76, adapted to fit securely around a top portion of the gas flow tube 42. A generally cylindrical wall 80 defines the socket opening 76. A step 81 (as shown in FIG. 2*d*) may be formed within the wall 80 to form a stop or upper limit, against which an upper edge of the gas flow tube 42 may rest. The generally cylindrical wall 80 may extend upwardly into a flared upper surface 82. In this embodiment, the socket 74 is secured within the deflector 40 by means of a support rib 84 (see FIGS. 2*a*, 2*c* and 2*e*), extending from the socket 74 to the inner surface 63 of the outer wall 60, and by an extension 86 (see FIGS. 2*c* and 2*e*) of the flared upper surface 82 which extends between the flared upper surface 82 and a windward side of the initial contact surface 70.

The opening 76 of the socket 74 is located below the top edge 73 of the initial contact surface 70.

Advantageously, the deflector 40 (and/or the top canister 22) may have a means known to those skilled in the art (not shown) to help ensure that the inlet tube 28 and/or the inlet fitting 26 is/are tightly sealed so that all fluid from the inlet tube 28 is directed into the deflector 40.

The deflector may be made from a suitable plastic, metal, or other material. Advantageously, the material chosen for the deflector will have similar expansion properties as the material(s) used to manufacture the accumulator, so that both the accumulator and the deflector will expand or contract in a comparable manner in response to the application of heat or cold.

The accumulator 20 may be assembled as generally suggested by FIG. 1*c*. The accumulator 20 may be assembled as follows. The desiccant container 44 is lowered into the liner 36. The outer surface of the desiccant container 44 and the inner surface of the liner 36 are adapted to ensure that no fluid can flow between them. For example, the inner surface of the liner 36 may incorporate a small horizontal half bead (not shown), to provide a tight seal between the two surfaces. Many other techniques could be used to achieve the same result.

The gas flow tube 42 is then inserted through the opening formed within the desiccant container 44. The outer diameter of the gas flow tube 42 is sized such that it is slightly smaller than the inner diameter of the opening formed within the desiccant container 44, but still forms a tight seal between the two surfaces.

The deflector 40 then slides into position within the liner 36. The lower portion 61 of the deflector 40 is sized to fit securely within a top portion of the liner 36. A top edge of the liner 36 rests against the step 62 of the deflector 40. The gas flow tube 42 fits securely within the opening 76 of the gas flow tube socket 74. The flared upper surface 82 of the socket 74 reduces the pressure drop across the opening to the outlet tube 42.

The liner 36 is then placed within the bottom canister 24. There is a gap between an inside surface of the bottom canister 24 and the outer surface 46 of the liner 36 defined or determined (in this embodiment) by the extent to which the liner ribs 54 project from the outer surface 46. The size of the gap may be adjusted. The larger the gap, the smaller the pressure drop through the accumulator 20, at the expense of the volume within the liner 36.

The top canister 22 is secured to the bottom canister 24. Advantageously, there is a fitting or other adaptation (not shown) to help ensure a fluid-tight seal between a top edge of the deflector 40 and an inside surface of the top canister 22. This helps prevent liquid carryover and may allow a top of the gas flow tube 42 to be near a top of the top canister 22, thereby increasing the effective accumulator volume, because a greater volume of liquid can be held in the accumulator without the liquid entering the gas flow tube 42. The top canister 22 is positioned on the deflector 40 such that the inlet entrance 64 of the deflector 40 meets up with and seals around inlet fitting 26 of the top canister 22.

The top canister 22 and the bottom canister 24 may be made of aluminum or steel, for example, and welded together to form a hermetic seal.

In operation, fluid enters the accumulator 20 through inlet tube 28. The arrows shown in FIG. 1*b* illustrate the movement of the different components of the fluid. The fluid comprises liquid refrigerant, gaseous refrigerant and oil. The fluid entering the accumulator 20 flows against the initial contact surface 70. Because the initial contact surface 70 is convex, liquid (refrigerant and oil) hitting the initial contact surface 70 and reflecting off it will be directed away from (that is, not directly towards) the stream of incoming fluid. Accordingly, the shape of the initial contact surface 70 helps to reduce re-entrainment of liquid into gas. As well, because the initial contact surface 70 is slanted or sloped inwardly from the top edge 73 to the lower edge 72, liquid hitting the initial contact surface 70 and reflecting off it will be directed down. For liquid that flows along the initial contact surface 70, gravity causes the liquid to flow down the initial contact surface 70 and then along the inverted U-shaped lower edge 72 until the liquid contacts the inner surface 63 of the outer wall 60 of the deflector 40.

The design of the deflector 40, as described above, dissipates kinetic energy and improves the degree to which gaseous refrigerant is initially separated from liquid refrigerant and oil. Moreover, the shape or geometry of the initial contact surface 70 provides improved liquid/gas separation with less turbulence and reduced re-entrainment of gas with liquid. In other words, the liquid fluid is separated from the gaseous fluid with relatively minimal interaction with the gaseous refrigerant to avoid liquid re-entrainment.

When fluid flows into the initial contact surface 70, the liquid refrigerant and oil are directed down to the interior walls of the liner 36, while the gaseous refrigerant is separated and directed towards the gas flow tube 42. The oil and liquid refrigerant then flow downward due to gravity, typically along the inside surface of the liner 36. The liquid refrigerant and oil pass through the desiccant container 44, which removes moisture from the liquid refrigerant, and the liquid then settles on the floor of the liner 36.

Meanwhile, gaseous refrigerant flows into the opening 76 of the socket 74 and then down and out the gas flow tube 42 below the liner 36. The gaseous refrigerant then flows up through the gap between the liner 36 and the bottom canister 24 and then up to the outlet fitting 30, whereupon, the gaseous refrigerant exits the accumulator though the outlet conduit (not shown). As the gaseous refrigerant flows past the oil bleed orifice (not shown) near the nadir of the liner 36, oil (and possibly some liquid refrigerant) passing through the oil bleed orifice is entrained within the flow of gaseous refrigerant, and is carried up and out the outlet conduit (not shown) with the gaseous refrigerant.

Figure 3:
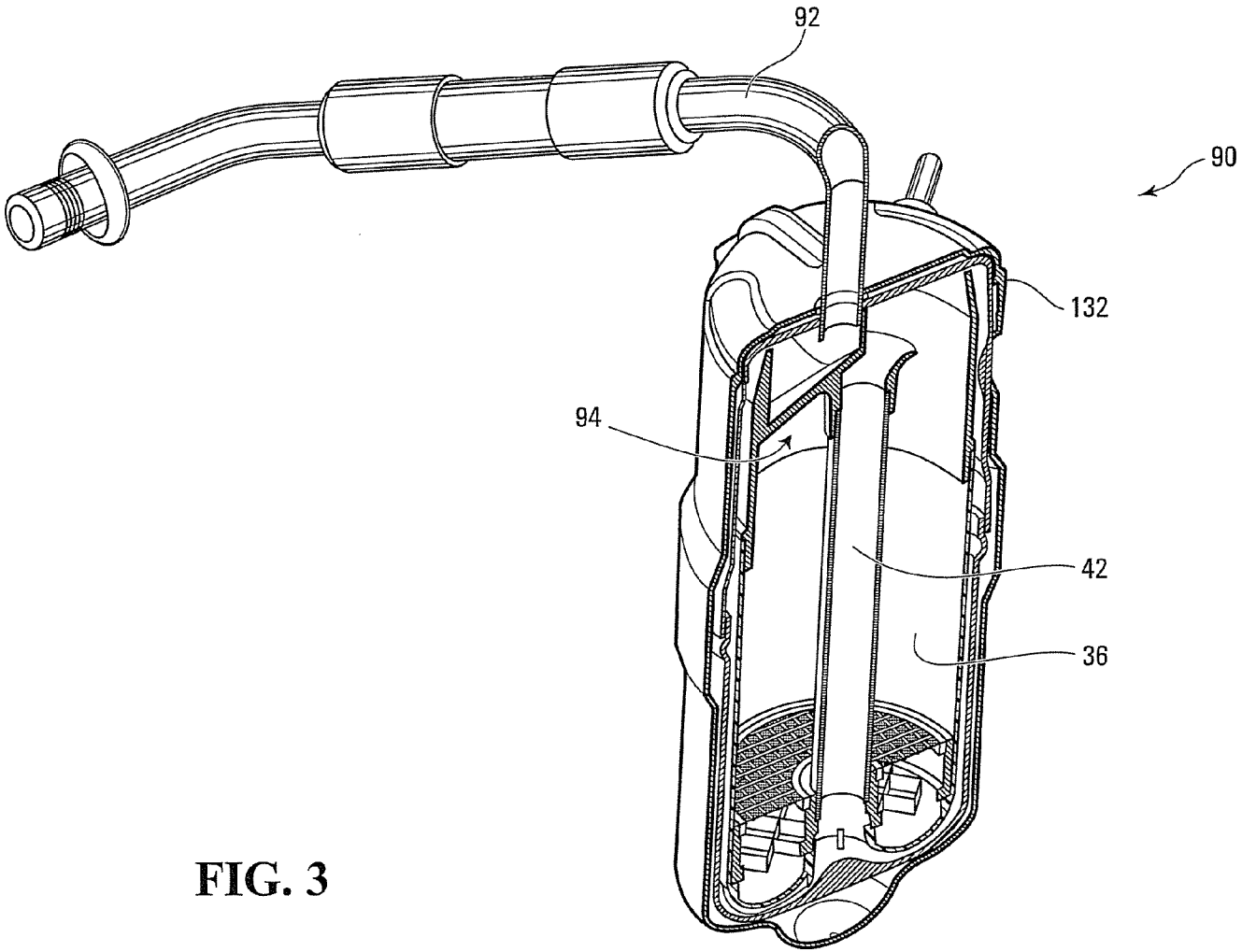
FIG. 3 is a perspective sectional view of a top-in-side-out (TISO) accumulator in accordance with another embodiment of the present invention.

The embodiments described above relate to a side-in-side-out (SISO) accumulator. However, the principles described above could also be applied to accumulators having other configurations. For example, a vertical, sectional view of a particular top-in-side-out (TISO) liner style accumulator is shown in FIG. 3. Instead of the inlet tube 28 entering the accumulator 20 from the side, as in FIG. 1*a*, FIG. 3 shows a TISO accumulator 90, having an inlet tube 92 which enters the accumulator 90 from the top. The major differences between the SISO accumulator 20 of FIGS. 1*a* and 1*b* and the TISO accumulator of FIG. 3 are the location of the inlet tubes 28 and 92 and the configuration of the deflectors 40 and 94, respectively.

Different views of the TISO deflector 94 are shown in FIGS. 4*a*-4*d*. The deflector 94 has an outer wall (or circumference) 96, which is generally cylindrical, with a slightly inwardly converging upper portion 100, and a lower portion 102, extending downward from a step 104. Vertical external ribs 106 extend outwardly from the outer wall 96. The outer wall 96 has an inner surface 110.

A separation wall 112 extends across the deflector 94, from one portion on the inner surface 110 to another portion on the inner surface 110. The separation wall 112 has a wavy shape, as shown in the top view of FIG. 4*c*. The wavy shape, in this embodiment, is designed to cooperate with the particular shape and placement of an inlet. Different embodiments may incorporate different shapes for the separation wall. A top edge of the separation wall 112 is generally flush with a top edge of the outer wall 96.

An initial contact surface 114 extends between the separation wall 112 and the inner surface 110 of the outer wall 96. The initial contact surface 114, as described below, is shaped so that liquid on the initial contact surface 114 flows towards, and then down, the inner surface 110 of the outer wall 96.

The combination, in this embodiment, of the separation wall 112 and the initial contact surface 114 may be referred to as a separation/protection means.

The initial contact surface 114 has an apex line (or ridge) 116. In this embodiment, the initial contact surface 114 is generally symmetrical about the apex line 116. Flow directing surfaces 118 and 120 are sloped both downward and towards the inner surface 110 of the outer wall 96. An outer flow directing surface 122 is positioned between the separation wall 112 and the flow direction surface 120, on each side of the apex line 116. Each outer flow directing surface 122 is sloped downward and towards its corresponding flow directing surface 120.

The overall shape of the initial contact surface 114 is substantially convex (in the direction across the initial contact surface 114), even though portions of the initial contact surface 114 may not be convex.

Figure 4A:
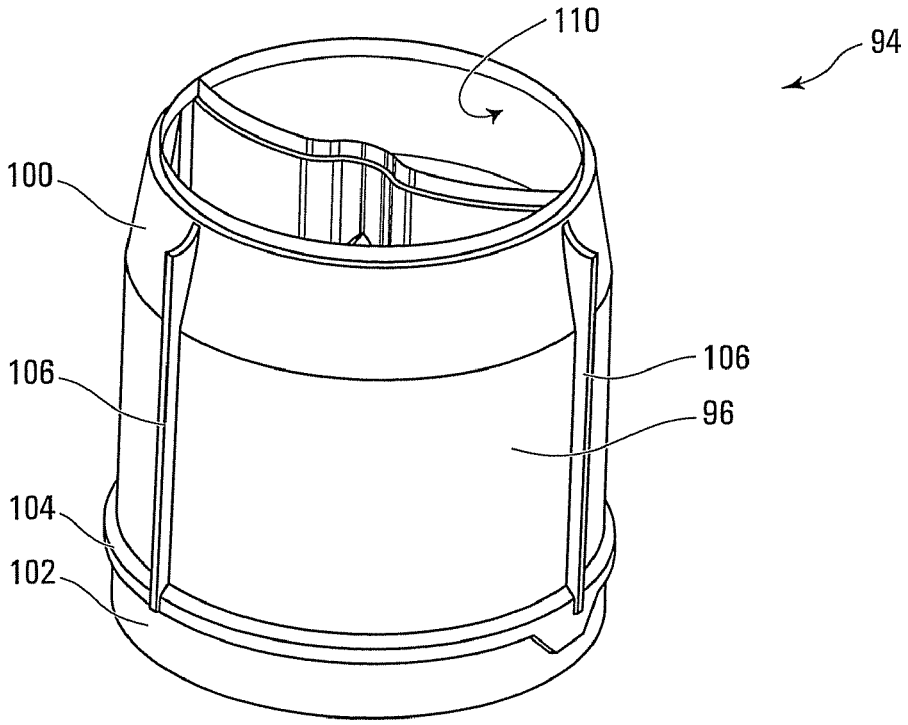
Figure 4B:
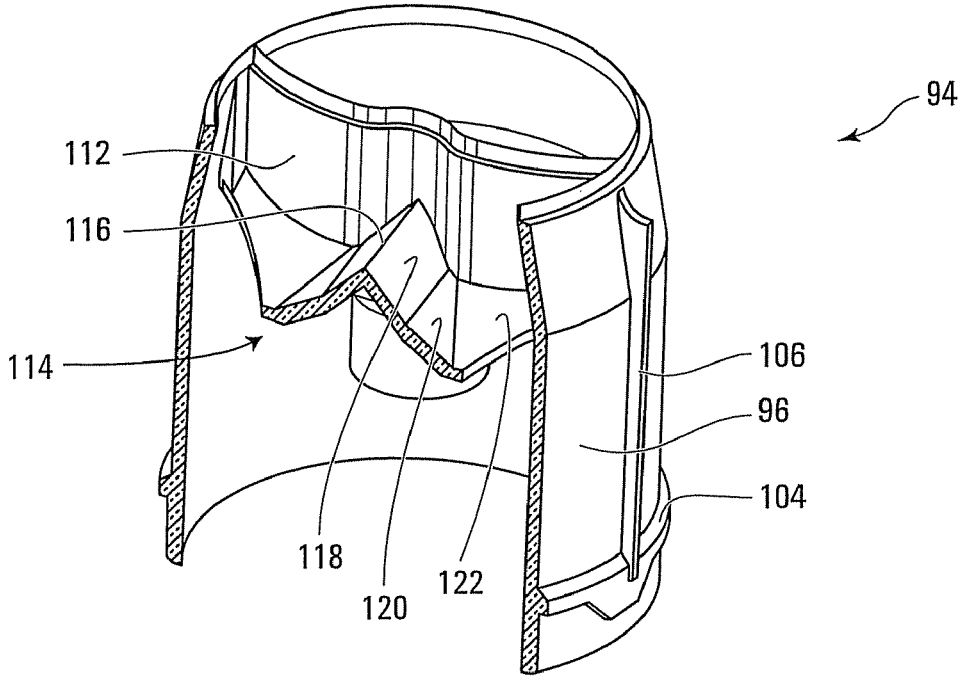
Figure 4C:
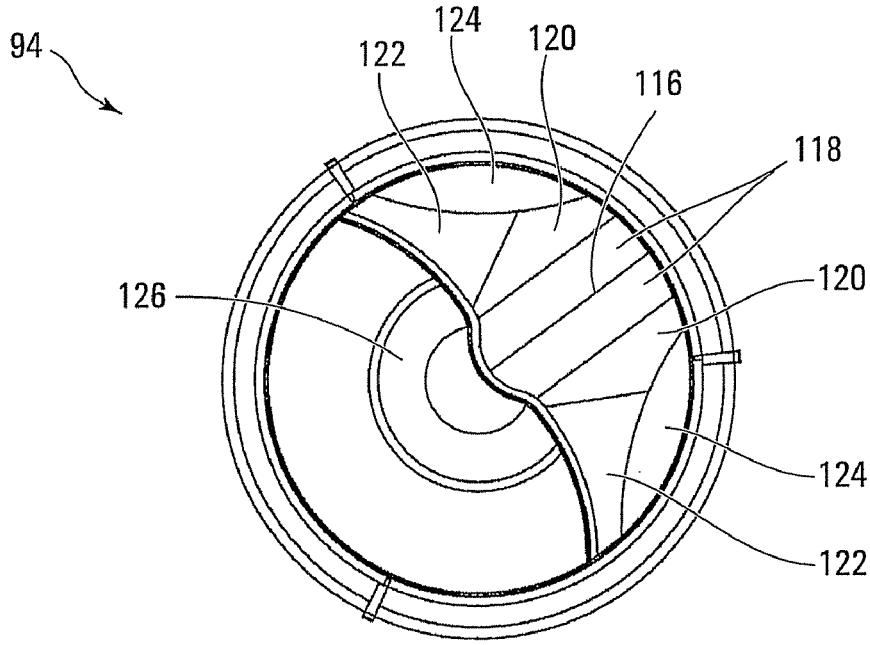
Figure 4D:
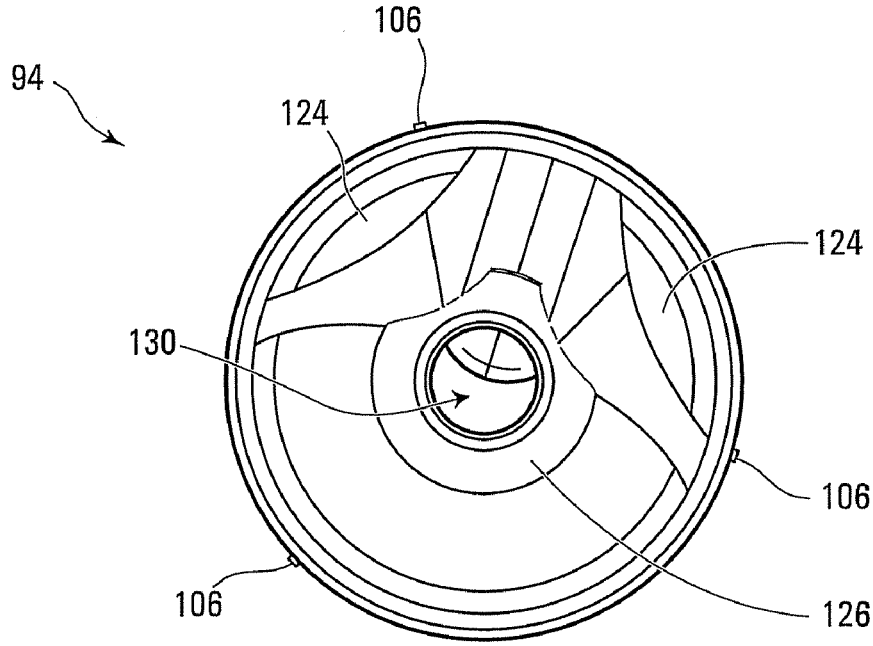

As shown in the top view of FIG. 4*c*, fluid openings 124 are formed between the initial contact surface 114 and the inner surface 110 of the outer wall 96. Edges of the initial contact surface 114 adjacent the fluid openings 124 may have beaded rims (or may be somewhat bulbous) to help liquid adhere to the rims, where the liquid is then directed toward the inner surface 110 (and away from the gas flow). As shown in the top and bottom views of FIGS. 4*c* and 4*d*, a socket 126 (of configuration similar to the socket 74 described above with respect to the SISO accumulator 20) is supported by the separation wall 112 and the underside of the initial contact surface 114. The socket 126 has a socket opening 130.

In operation, the deflector 94 and a top canister 132 of the accumulator 90 fit together so that the top edge of the separation wall 112 and the top edge of the outer wall 96 form a fluid tight seal against the top canister 132 (or against a fitting (not shown) within the top canister 132). Fluid from the inlet tube 92 is directed down into the accumulator 90, between the separation wall 112 and the inner surface 110 of the outer wall 96.

Fluid is directed towards the initial contact surface 114, where gaseous refrigerant is mostly (or at least partly) separated from liquid refrigerant and oil. The gaseous refrigerant flows though the fluid openings 124 formed in the deflector 94 and then into the socket opening 130 and down the gas flow tube 42 and then proceeds as described above with respect to the SISO accumulator 20. The liquid refrigerant and oil, upon hitting the initial contact surface 114, flow down the initial contact surface 114 to the inner surface 110 of the outer wall 96. The liquid refrigerant and oil then flow down the inner surface 110 and then down the inner surface of the liner 36 and then proceed as described above with respect to the SISO accumulator 20.

The embodiments of deflectors described above relate to a particular type of liner-style accumulators. However, the principles described above could be applied to a liner style accumulator of any type. In those cases, the configuration of the deflector may be modified to accommodate the particular features of the different types of liner-style accumulators.

Moreover, the deflector design principles described above could also be applied to accumulators that do not incorporate liners. In other words, the principles described above could be applied to other situations where it would, for example, be desirable to separate gaseous fluid from liquid fluid with minimal (or less) re-entrainment of liquid fluid with gaseous fluid and/or with less churning of the separated liquid fluid. For a J-tube style accumulator, the deflector would be adapted to protect an inlet of a J-tube from liquid entering the accumulator. Because a J-tube style accumulator does not typically incorporate a liner, a deflector used in such a liner would likely be modified from the designs described above. For example, the outer wall 60 of the deflector 40 shown in FIG. 2*a* could be modified for a J-tube style accumulator by flaring out the lower portion 61 so that the lower portion 61 engages (or comes close to engaging) an inner surface of the bottom canister 24 of the accumulator, so that liquid flowing down the inner surface 63 of the deflector 40 will be directed to the inner surface of the bottom canister 24 and be more likely to flow down the inner surface of the bottom canister 24.

Figure 2A:
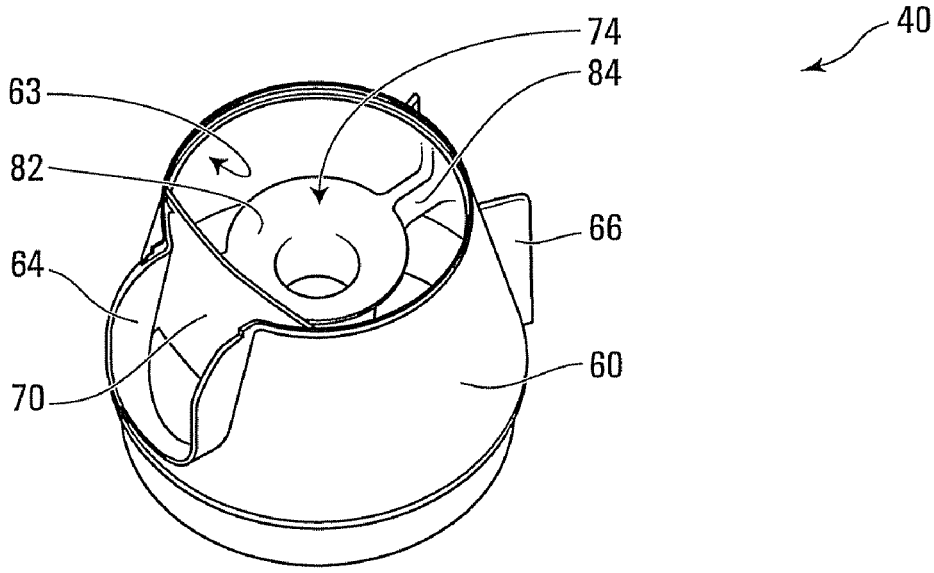
Figure 2B:
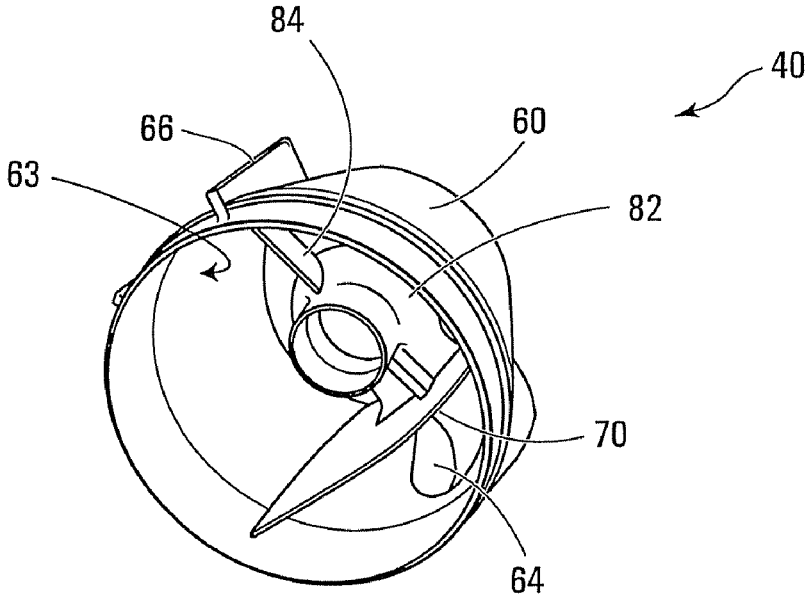
Figure 2C:
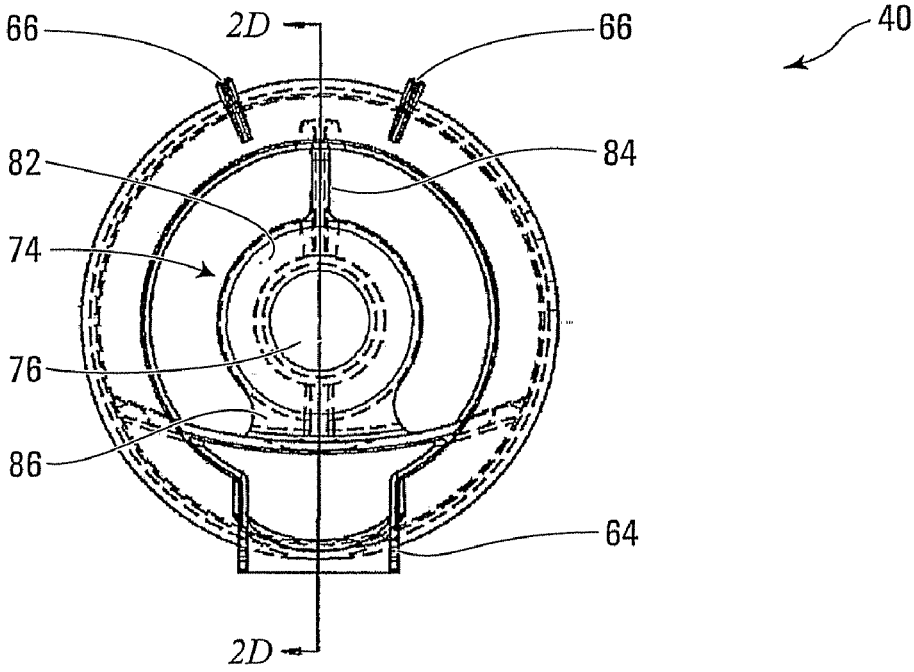
Figure 2D:
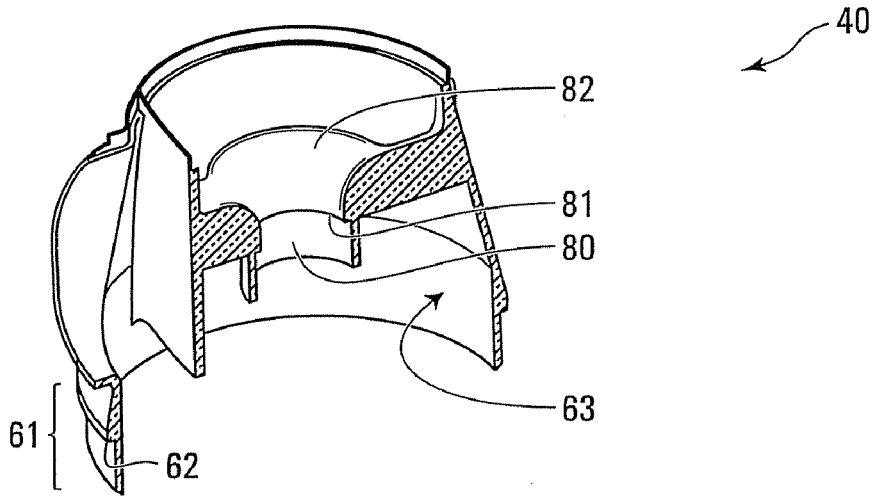
Figure 2E:
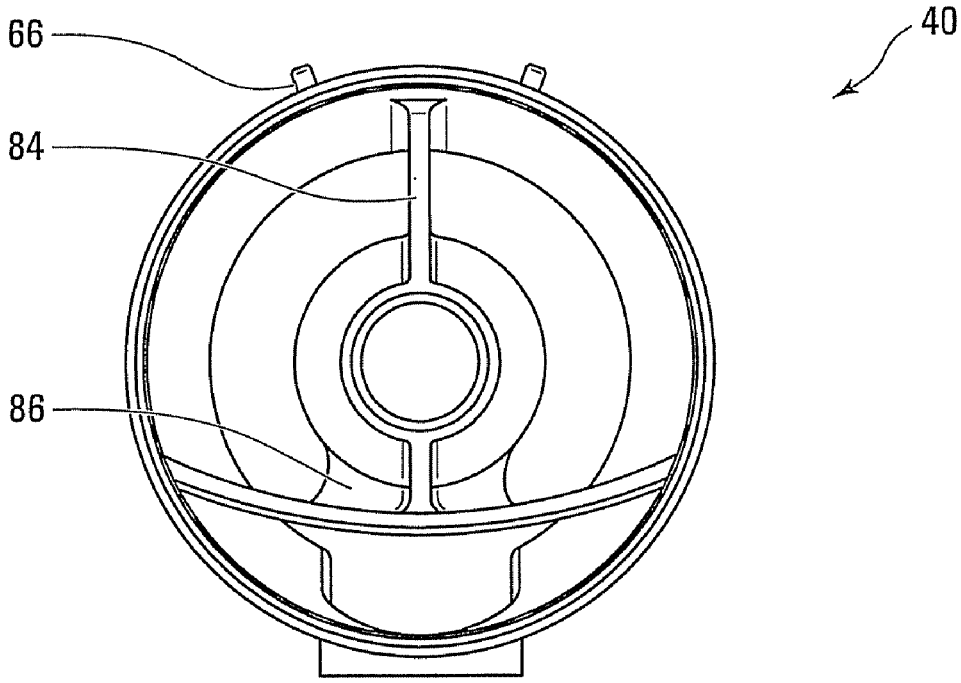
Figure 2F:
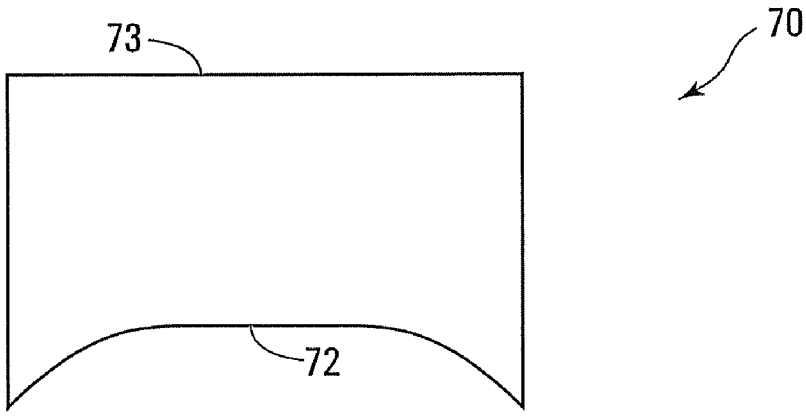

Alternatively, in an accumulator without a liner, it would not be necessary for a deflector to have a surrounding outer wall, such as outer wall 60 as shown in FIG. 2*a*. In other words, in an accumulator without a liner, because it would be desirable to direct liquid to flow down an inner surface of the bottom canister 24 (as opposed to an inner surface of a liner), an outer wall of the deflector, such as outer wall 60 of the deflector of FIG. 2*a* could be omitted.

Figure 6A:
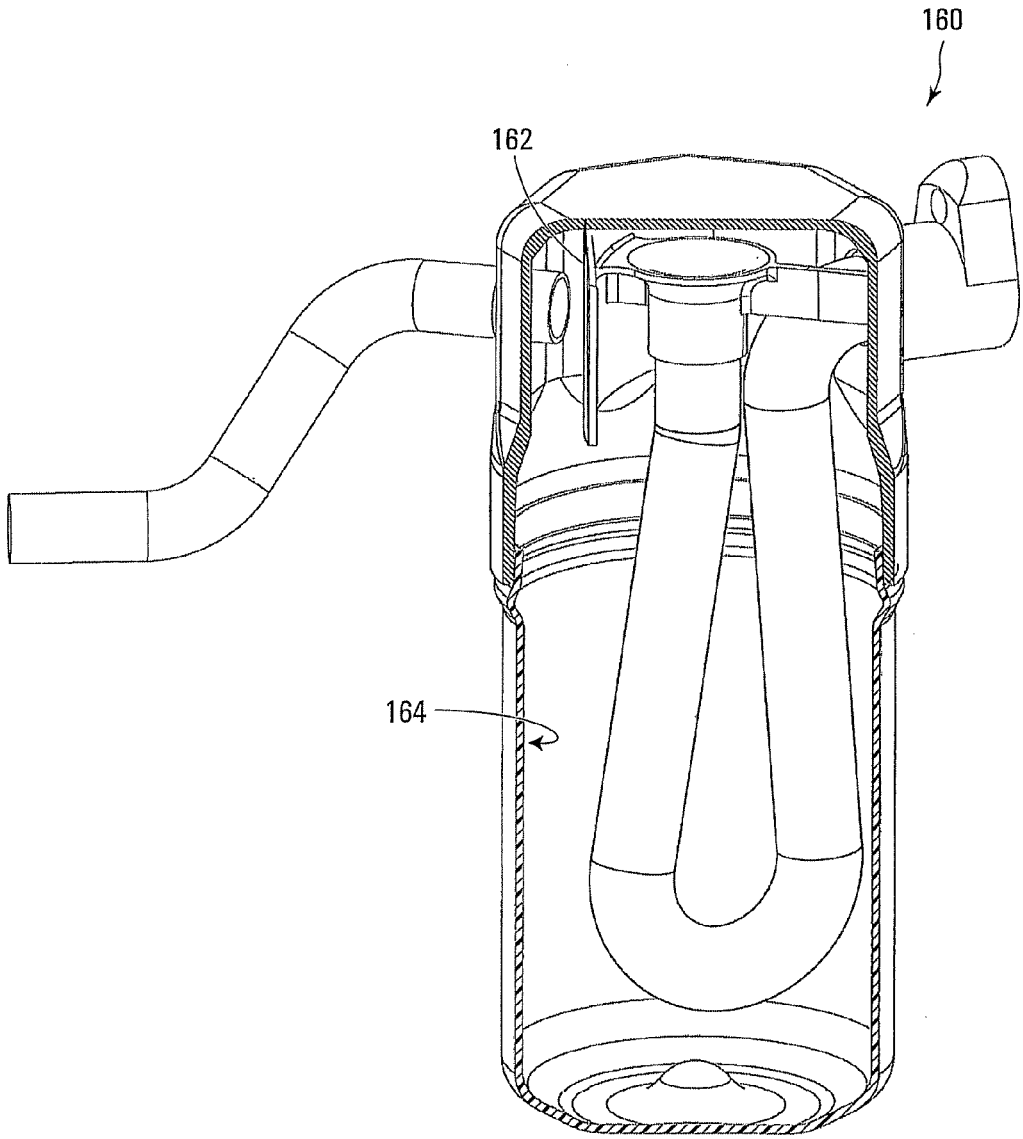
FIG. 6*a* is a perspective view of a SISO style accumulator, with a portion of the accumulator top and bottom canisters removed for greater clarity, in accordance with another embodiment of the present invention.
Figure 6B:
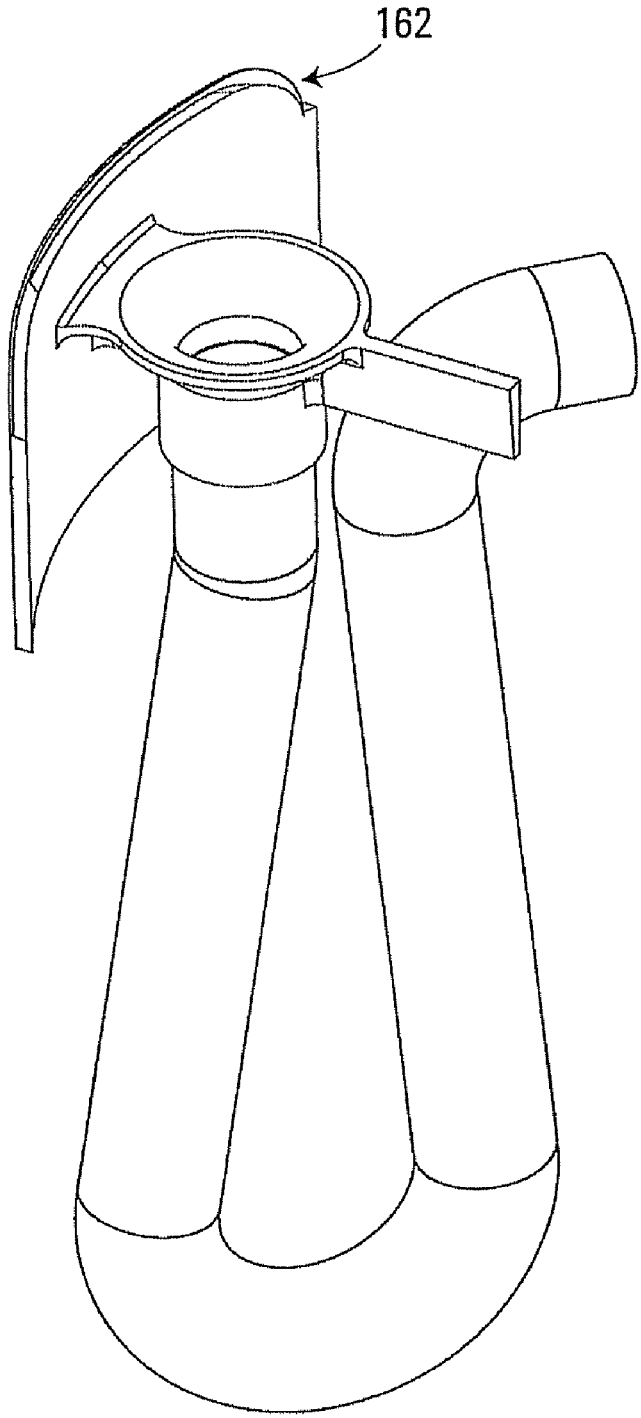
FIG. 6*b* is a perspective view of the J-tube and deflector of FIG. 6*a.*

An embodiment of one such SISO J-tube style accumulator is shown in FIGS. 6*a* and 6*b*. In this embodiment, fluid enters an accumulator 160 and hits the deflector 162. The accumulator 162 has an inner surface 164. Although perhaps not clear from FIG. 6*a*, the bottom edge of the deflector 162 comes into contact with, or approaches the inner surface 164 of the accumulator 160.

Similarly, a TISO accumulator without a liner could also use the concepts described above. For example, the deflector 94 shown in FIG. 4*a* could be modified as required. The lower portion 102 in FIG. 4*a* could be flared outward to approach or meet an inner surface of the bottom canister 24. Alternatively, the outer wall 96 could be completely or partially omitted so that liquid, instead of being directed to the inner surface 110 of the deflector 94, would be directed towards an inner surface of the bottom canister, as suggested in FIGS. 5*a*-5*c*. An example of one such deflector is described as follows.

Figure 5A:
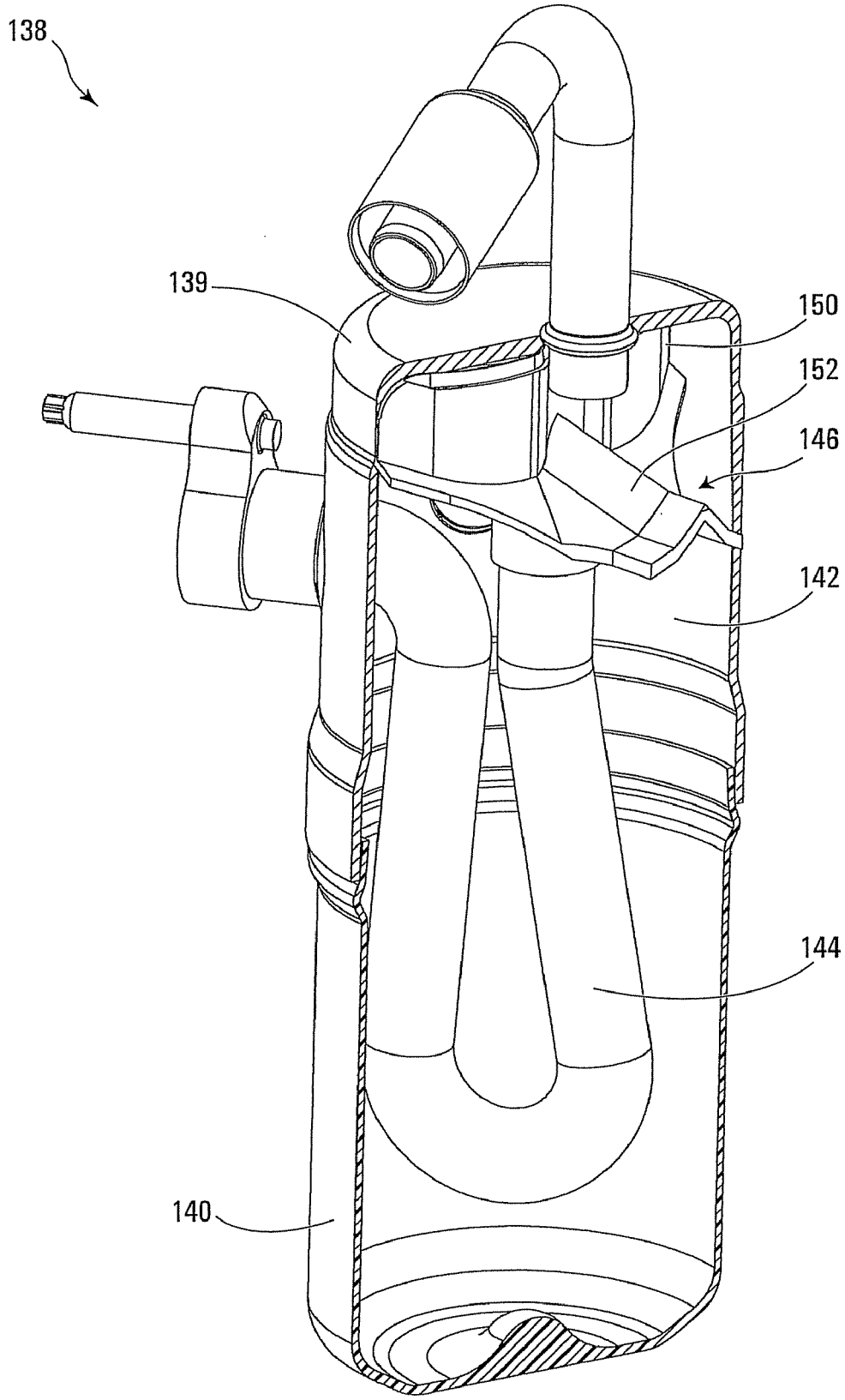
FIG. 5*a* is a perspective view of a TISO J-tube style accumulator, with a portion of the accumulator top and bottom canisters removed for greater clarity, in accordance with another embodiment of the present invention.
Figure 5B:
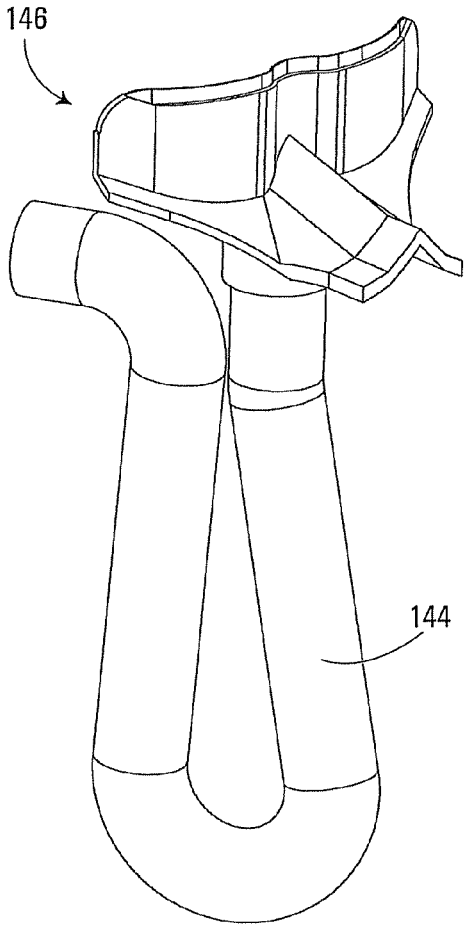
FIG. 5*b* is a perspective view of the J-tube and deflector of FIG. 5*a;*
Figure 5C:
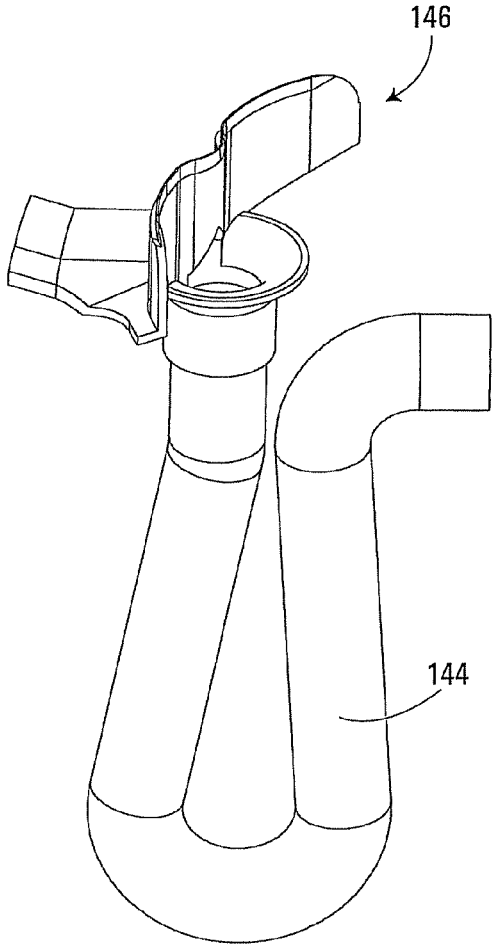
FIG. 5*c* is a perspective view of the J-tube and deflector of FIG. 5*b*, from a different perspective.

FIG. 5*a* shows a J-tube style accumulator 138, having a top canister 139 and a bottom canister 140. The accumulator 138 incorporates a J-tube 144 (which could also be referred to as a U-tube). The accumulator 138 has an inner surface 142. The accumulator 138 has a deflector 146, having a separation wall 150 and an initial contact surface 152. The deflector 146 in this embodiment is substantially similar to the combination of the separation wall 112 and the initial contact surface 114 of the TISO deflector 94 of FIGS. 4*a*-4*c*. One difference between the embodiment of FIGS. 4*a*-4*c* from the embodiment of FIGS. 5*a*-5*c*, is that in the embodiment of FIGS. 4*a*-4*c*, fluid reflecting off the initial contact surface 114 is directed towards the inner surface 110 of the deflector 94. In contrast, fluid reflecting off the initial contact surface 152 of the deflector 146 of the embodiment of FIGS. 5*a*-5*c* is directed to the inner surface 142 of the accumulator 138.

The deflector 146 shown in the embodiment of FIGS. 5*a*-5*c* is secured to the J-tube 144. In different embodiments (not shown) the deflector could be secured to the top canister 139 or possibly the bottom canister 140.

Numerous modifications and variations of the present invention are possible in light of the above teachings. It is therefore to be understood that within the scope of the appended claims, the invention may be practiced otherwise than as specifically described herein. For example, the embodiments of the accumulator designs described above have a single inlet. However, different embodiments could have more than a single inlet.

What is claimed is:

1. An accumulator for an air conditioning system, the accumulator comprising an outer body, a liner inside and spaced from the outer body, a conduit primarily for gas, and a deflector comprising a generally cylindrical circumference with an inner surface, wherein the inner surface of the circumference of the deflector is adjacent an inside surface of the liner and the deflector further comprising a separation/protection means to separate liquid from gas, wherein a portion of the separation/protection means comprises a barrier to substantially prevent liquid from entering the conduit and a portion of the separation/protection means comprises an initial contact surface for directing fluid away from a flow of incoming fluid, wherein the initial contact surface is substantially convex across the initial contact surface and the initial contact surface, as seen from an upper edge to a lower edge thereof, is angled away from the flow of incoming fluid.

2. The accumulator of claim 1 wherein incoming fluid enters from a side of the accumulator and the barrier is the initial contact surface.

3. The accumulator of claim 2 further comprising an inlet located on a side of the outer body adapted to allow incoming fluid to enter the accumulator, wherein the initial contact surface is located between the inlet and an entrance to the conduit, the initial contact surface substantially preventing any liquid from the inlet from flowing into the entrance of the conduit, but allowing gas to flow into the entrance of the conduit, the initial contact surface comprising a generally inverted U-shaped lower edge, with ends of the lower edge being in contact with the inner surface of the circumference of the deflector.

4. The accumulator of claim 3 wherein the lower edge of the initial contact surface comprises a beaded rim.

5. The accumulator of claim 1 wherein the initial contact surface extends across the circumference of the deflector, from one portion of the inner surface to another portion of the inner surface.

6. The accumulator of claim 1 wherein the deflector is secured to the liner.

7. The accumulator of claim 1 further comprising an inlet located on a top of the accumulator, and the initial contact surface slopes downward and outward toward the inner surface of the circumference of the deflector.

8. The accumulator of claim 7 wherein the barrier of the separation/protection means comprises a wall extending across the circumference from one portion of the inner surface to another portion of the inner surface, with the inlet being located on one side of the barrier and an opening of the conduit being located on the other side of the barrier.

9. The accumulator of claim 8 wherein the initial contact surface extends between the barrier and the inner surface of the circumference.

10. The accumulator of claim 9 wherein the initial contact surface comprises an apex ridge located approximately midway along the initial contact surface and extending between the barrier and the inner surface of the circumference.

11. The accumulator of claim 10 wherein the deflector comprises one or more openings formed between the initial contact surface and the inner surface of the circumference to allow gas and liquid to flow through the openings.

12. The accumulator of claim 1 wherein the deflector further comprises a flared socket having an upper portion and a lower portion, the upper portion being of greater diameter than the lower portion and the lower portion engaging an entrance of the conduit.

13. The accumulator of claim 1 wherein a top edge of the barrier is sealed against the outer body to prevent fluid from passing between the top edge and the outer body.

* * * * *